US007326331B2

(12) United States Patent
Benazzi et al.

(10) Patent No.: US 7,326,331 B2
(45) Date of Patent: Feb. 5, 2008

(54) PROCESS FOR THE PRODUCTION OF MIDDLE DISTILLATES BY HYDROISOMERISATION AND HYDROCRACKING FEEDS FROM THE FISCHER-TROPSCH PROCESS

(75) Inventors: Eric Benazzi, Chatou (FR); Christophe Gueret, St. Romain en Gal (FR)

(73) Assignees: Institut Francais du Petrole, Rueil, Mal Masion, Cedex (FR); AGIP Petroli, Rome (IT); ENI S.p.A., Rome (IT); Enitechnologies E Uffici Di Via, San Donato Milanese Milano (IT)

( * ) Notice: Subject to any disclaimer, the term of this patent is extended or adjusted under 35 U.S.C. 154(b) by 548 days.

(21) Appl. No.: 10/189,736

(22) Filed: Jul. 8, 2002

(65) Prior Publication Data

US 2003/0057134 A1 Mar. 27, 2003

(30) Foreign Application Priority Data

Jul. 6, 2001 (FR) ..... 01 08969

(51) Int. Cl.
*G10G 65/14* (2006.01)
*G10G 45/00* (2006.01)

(52) U.S. Cl. ..... 208/78; 208/80; 208/89

(58) Field of Classification Search ..... 208/78, 208/80, 950, 89, 79
See application file for complete search history.

(56) References Cited

U.S. PATENT DOCUMENTS 2,944,001 A * 7/1960 Kimberlin, Jr. ..... 208/80
2,944,959 A * 7/1960 Kline et al. ..... 208/79
5,371,308 A * 12/1994 Gosselink et al. ..... 585/251
5,378,348 A 1/1995 Davis et al.
5,660,714 A * 8/1997 Wittenbrink et al. ..... 208/79
6,037,300 A * 3/2000 Kasztelan et al. ..... 502/204
6,113,775 A * 9/2000 Christolini et al. ..... 208/80
6,656,343 B2 * 12/2003 Dancuart ..... 208/58

(Continued)

FOREIGN PATENT DOCUMENTS

EP 0297949 1/1989

(Continued)

OTHER PUBLICATIONS

Benazzi et al. U.S. Appl. No. 10/189,759, filed Jul. 8, 2002.

(Continued)

*Primary Examiner*—Glenn Caldarola
*Assistant Examiner*—John Douglas
(74) *Attorney, Agent, or Firm*—Millen White Zelano & Branigan, P.C.

(57) ABSTRACT

The invention concerns a process for producing middle distillates from effluents obtained from the Fischer-Tropsch process, comprising separating a heavy cut with an initial boiling point of 120-200° C., hydrotreating said cut and fractionating the hydrotreated cut to obtain at least one intermediate fraction and at least one fraction that is heavier than the intermediate fraction. The intermediate fraction boils between T1 and T2, T1 being in the range 120-200° C. and T2 being in the range 300-410° C. The heavy and intermediate fractions are treated over a hydrocracking/hydroisomerisation catalyst and the effluents obtained are distilled. The invention also concerns a unit.

14 Claims, 1 Drawing Sheet

U.S. PATENT DOCUMENTS 7,156,978 B2 * 1/2007 Benazzi et al. ..... 208/78

FOREIGN PATENT DOCUMENTS

EP 0321303 6/1989
EP 583836 A1 * 2/1994
EP 1048346 11/2000

OTHER PUBLICATIONS

Benazzi et al. U.S. Appl. No. 10/189,793, filed Jul. 8, 2002.
Benazzi et al. U.S. Appl. No. 10/189,738, filed Jul. 8, 2002.

* cited by examiner

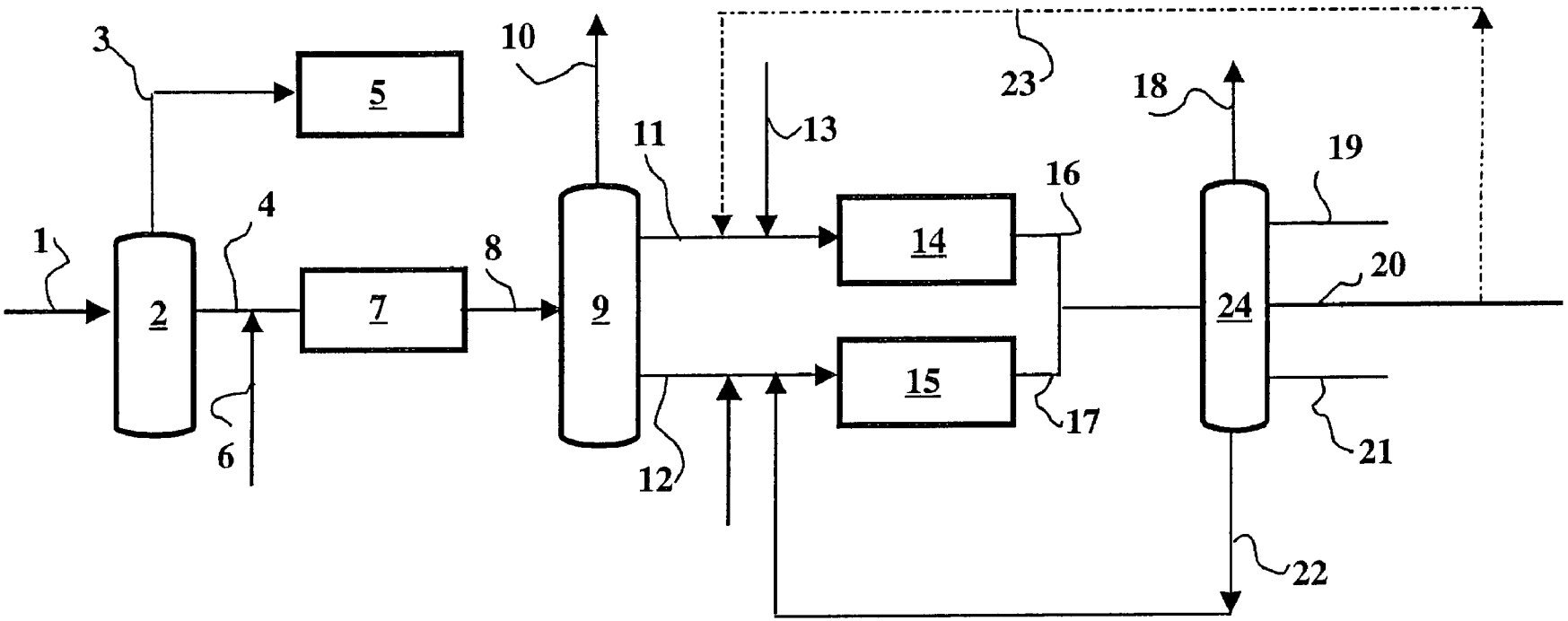
1
2
3
4
5
6
7
8
9
10
11
12
13
14
15
16
17
18
19
20
21
22
23
24

PROCESS FOR THE PRODUCTION OF MIDDLE DISTILLATES BY HYDROISOMERISATION AND HYDROCRACKING FEEDS FROM THE FISCHER-TROPSCH PROCESS

CROSS REFERENCE TO RELATED APPLICATION

This application claims priority of French Application No. 01/08.969 filed Jul. 6, 2001 and international application PCT/FR02/02.204 filed Jun. 26, 2002.

The present invention relates to a process and a unit for treating feeds from the Fischer-Tropsch process by hydrocracking and hydroisomerisation to obtain middle distillates (gas oil, kerosine).

In the Fischer-Tropsch process, synthesis gas ($CO+H_2$) is catalytically transformed into oxygen-containing products and essentially linear gaseous, liquid or solid hydrocarbons. The products are generally free of heteroatomic impurities such as sulphur, nitrogen or metals. They contain practically no aromatics, naphthenes or, more generally, cyclic compounds, in particular when cobalt catalysts are used. In contrast, they can include a non negligible quantity of oxygen-containing compounds which, expressed as the weight of oxygen, is generally less than about 5% by weight, and also a quantity of unsaturated compounds (generally olefins) that is generally less than 10% by weight. However, these products, principally constituted by normal paraffins, cannot be used as they are, in particular because their cold properties are not compatible with the normal use of petroleum cuts. As an example, the pour point of a linear hydrocarbon containing 20 carbon atoms per molecule (boiling point of about 340° C., i.e., usually included in the middle distillate cut) is about +37° C., rendering it impossible to use, as the specification for gas oil is −15° C. Hydrocarbons from the Fischer-Tropsch process mainly comprising n-paraffins must be transformed into products with a higher added value such as gas oil, kerosine, which are obtained after catalytic hydroisomerisation reactions, for example.

European patent EP-A-0 583 836 describes a process for the production of middle distillates from a feed obtained from the Fischer-Tropsch process. In that process, the whole of the feed is treated, although it is possible to remove the $C_4$− fraction and obtain a $C_5^+$ fraction boiling at about 100° C. Said feed undergoes hydrotreatment then hydroisomerisation with conversion (of products boiling above 370° C. to products with a lower boiling point) of at least 40% by weight. A catalyst that can be used in hydroconversion is a formulation involving platinum on silica-alumina. Conversions of at most 60% by weight are described in the examples.

EP-A-321 303 also describes a process for treating said feeds with a view to producing middle distillates and possibly oils. In one implementation, the middle distillates are obtained by a process consisting of treating the heavy fraction of the feed, i.e., with an initial boiling point in the range 232° C. to 343° C., by hydroisomerisation over a fluorine-containing catalyst containing a group VIII metal and alumina and with particular physico-chemical characteristics. After hydroisomerisation, the effluent is distilled and the heavy portion is recycled to the hydroisomerisation step. The hydroisomerisation conversion for 370° C.+ products is given as being in the range 50-95% by weight and the examples disclose up to 85-87%.

The present invention proposes an alternative process for producing middle distillates without producing oils. This process can:

- substantially improve the cold properties of paraffins from the Fischer-Tropsch process and having boiling points corresponding to those of gas oil and kerosine fractions (also known as middle distillates) and in particular, it can improve the freezing point of kerosines;
- increase the quantity of available middle distillates by hydrocracking the heaviest paraffins present in the effluent leaving the Fischer-Tropsch process with boiling points that are higher than those of the kerosine and gas oil cuts, for example the 380° C.+ fraction.

More precisely, the invention concerns a process for producing middle distillates from a paraffin feed produced by the Fischer-Tropsch process, comprising the following successive steps:

a) separating a single fraction, termed the heavy fraction, with an initial boiling point in the range 120-200° C.;
b) hydrotreating at least a portion of said heavy fraction;
c) fractionating into at least three fractions:
   - at least one intermediate fraction with an initial boiling point T1 in the range 120° C. to 200° C., and an end point T2 of more than 300° C. and less than 410° C.;
   - at least one light fraction with a boiling point below that of the intermediate fraction;
   - at least one heavy fraction with a boiling point above that of the intermediate fraction;
d) passing at least a portion of said intermediate fraction over an amorphous hydroisomerisation/hydrocracking catalyst;
e) passing at least a portion of said heavy fraction over an amorphous hydrocracking/hydroisomerisation catalyst;
f) distilling the hydrocracked/hydroisomerised fractions to obtain middle distillates, and recycling the residual fraction with a boiling point above that of said middle distillates to step e) over the amorphous catalyst treating the heavy fraction.

In more detail, the steps are as follows:

a) The paraffin effluent from the Fischer-Tropsch synthesis unit is fractionated (for example distilled) into at least two fractions. One (or more) light fractions is/are separated from the feed to obtain a heavy fraction with an initial boiling point equal to a temperature in the range 120° C. to 200° C., and preferably in the range 130° C. to 180° C., for example about 150° C., the light fraction boiling below the heavy fraction. The heavy fraction generally has a paraffin content of at least 50% by weight.
b) At least a portion (preferably all) of said heavy fraction is brought into contact with a hydrotreatment catalyst in the presence of hydrogen.
c) The hydrotreated paraffin effluent is fractionated into at least three fractions:
   - a light fraction comprising compounds with boiling points of less than a temperature T1 in the range 120° C. to 200° C., preferably in the range 130° C. to 180° C., for example about 150° C. In other words, the T1 cut point is in the range 120° C. to 200° C.;
   - an intermediate fraction comprising compounds with boiling points in the range from the cut point T1 as defined above to a temperature T2 of more than 300° C., more preferably more than 350° C. and less than 410° C., still more preferably 370° C.;
   - a heavy fraction comprising compounds with boiling points that are higher than the end point T2 defined above.

The intermediate and heavy fractions generally have paraffin contents of at least 50% by weight.

d) At least a portion (preferably all) of the intermediate fraction is brought into contact with a hydroisomerisation/hydrocracking catalyst in the presence of hydrogen to produce middle distillates.

e) at least a portion (preferably all) of the heavy fraction is brought into contact with a hydroisomerisation/hydrocracking catalyst in the presence of hydrogen to produce middle distillates.

f) The effluents leaving steps d) and e) undergo a separation step in a distillation string to separate the light products inevitably formed during said steps, for example (C1-C4) gas, and a gasoline cut, and also to distil at least one gas oil cut and also at least one kerosine cut, and also to distil the non hydrocracked fraction the constituent compounds of which have boiling points that are higher than those of the middle distillates (kerosine+gas oil). This non-hydrocracked fraction (termed the residual fraction) generally has an initial boiling point of at least 350° C., preferably more than 370° C. This residual fraction is recycled to step e) over the hydroisomerisation/hydrocracking catalyst treating the heavy fraction.

Unexpectedly, the use of a process of the invention has brought about a number of advantages. In particular, it has been discovered that it is important not to treat the light hydrocarbon fraction in the Fischer-Tropsch effluent, which light fraction comprises, in terms of boiling points, a gasoline cut ($C_5$ to at most 200° C. and usually to about 150° C.).

Unexpectedly, the results obtained demonstrate that it is better to send said gasoline cut ($C_5$ to at most 200° C.) to a steam cracker to produce olefins than to treat it in the process of the invention, as it has been shown that the quality of this cut is only slightly improved. In particular, its motor octane number and research octane number remain too low for that cut to be incorporated into the gasoline pool. The process of the invention can produce middle distillates (kerosine, gas oil) with a minimum of gasoline obtained. Further, the middle distillates (kerosine+gas oil) yields of the process of the invention are higher than in the prior art, in particular due to the fact that the kerosine cut (generally with an initial boiling point of 150° C. to 160° C. to an end point of 260° C. to 280° C.) has been optimised (or even maximised with respect to the prior art), and further, with no detriment to the gas oil cut. In addition, this kerosine cut unexpectedly has excellent cold properties (freezing point, for example).

The fact that the light fraction from the Fischer-Tropsch effluent is not treated means that the volumes of hydrotreatment and hydroisomerisation catalysts used can be minimised, thus minimising reactor size and reducing costs.

Still further, and unexpectedly, the catalytic performances (activity, selectivity) and/or duration of the cycle for the hydrotreatment and hydroisomerisation catalysts used in the process of the invention have been improved.

BRIEF DESCRIPTION OF DRAWING

FIG. 1 is a schematic flowsheet of a preferred embodiment of the invention.

DETAILED DESCRIPTION OF THE INVENTION

The description refers to FIG. 1, although FIG. 1 does not limit the scope of the invention.

Step a)

The effluent from the Fischer-Tropsch synthesis unit comprises mainly paraffins, but also contains olefins and oxygen-containing compounds such as alcohols. It also contains water, $CO_2$, CO and unreacted hydrogen as well as light C1 to C4 hydrocarbons in gas form. The effluent from the Fischer-Tropsch synthesis unit arriving via line 1 is fractionated (for example by distillation) in a separation means (2) into at least two fractions: at least one light fraction and a heavy fraction with an initial boiling point equal to a temperature in the range 120° C. to 200° C., preferably in the range 130° C. to 180° C. and more preferably at a temperature of about 150° C.; in other words the cut point is between 120° C. and 200° C. The light fraction of FIG. 1 leaves via line (3) and the heavy fraction leaves via line (4).

Fractionation can be carried out using methods that are well known to the skilled person, such as flash, distillation, etc . . . In a non-limiting example, the effluent from the Fischer-Tropsch synthesis unit undergoes flash, decanting to eliminate water and distillation to obtain at least the two fractions described above.

The light fraction is not treated in the process of the invention but can, for example, constitute a good petrochemicals feed, more particularly for a steam cracking unit (5). The heavy fraction described above is treated in the process of the invention.

Step b)

This fraction is admitted in the presence of hydrogen (line 6) into a zone (7) containing a hydrotreatment catalyst to reduce the amount of olefinic and unsaturated compounds and to hydrotreat the oxygen-containing compounds (alcohols) present in the heavy fraction described above.

The catalysts used in this step b) are non cracking hydrotreatment catalysts or slightly cracking hydrotreatment catalysts comprising at least one metal from group VIII and/or group VI of the periodic table. Preferably, the catalyst comprises at least one metal from the group formed by nickel, molybdenum, tungsten, cobalt, ruthenium, indium, palladium and platinum, and comprises at least one support.

The hydrodehydrogenating function is preferably supplied by at least one group VIII metal or compound of a group VIII metal such as nickel or cobalt. A combination of at least one metal or compound of a metal from group VI of the periodic table (in particular molybdenum or tungsten) and at least one metal or compound of a metal from group VIII of the periodic table (in particular cobalt or nickel) can be used. The concentration of non-noble group VIII metal, when used, is 0.01-15% by weight with respect to the finished catalyst.

Advantageously, at least one element selected from P, B, Si is deposited on the support.

This catalyst can advantageously contain phosphorus; this compound has two advantages over hydrotreatment catalysts: facility of preparation, in particular when impregnating nickel and molybdenum solutions, and better hydrogenation activity.

In a preferred catalyst, the total concentration of group VI and VIII metals, expressed as the metal oxides, is in the range 5% to 40% by weight, preferably in the range 7% to 30% by weight, and the weight ratio, expressed as the oxide of the group VI metal (or metals) over the group VIII metal (or metals) is in the range 1.25 to 20, preferably in the range 2 to 10. Advantageously, if it contains phosphorus, the concentration of phosphorus pentoxide, $P_2O_5$, is less than 15% by weight, preferably less than 10% by weight.

It is also possible to use a catalyst containing boron and phosphorus; advantageously, the boron and phosphorus are promoter elements deposited on the support, for example the catalyst described in EP-A-297 949. The sum of the quantities of boron and phosphorus, expressed respectively as the weight of boron trioxide and phosphorus pentoxide, with respect to the weight of the support, is about 5% to 15%, the atomic ratio of boron to phosphorus is about 1:1 to 2:1 and at least 40% of the total pore volume of the finished catalyst is contained in pores with a mean diameter of more than 13 nanometers. Preferably, the quantity of group VI metal such as molybdenum or tungsten is such that the atomic ratio of phosphorus to group VIB metal is about 0.5:1 to 1.5:1; the quantities of group VIB metal to group VIII metal, such as nickel or cobalt, are such that the atomic ratio of group VIII metal to group VIB metal is about 0.3:1 to 0.7:1. The quantities of group VIB metal, expressed as the weight of metal with respect to the weight of finished catalyst, is about 2% to 30% and the quantity of group VIII metal, expressed as the weight of metal with respect to the weight of finished catalyst, is about 0.01% to 15%.

A further particularly advantageous catalyst contains a silicon promoter deposited on a support. An important catalyst contains BSi or PSi.

Ni on alumina catalysts, NiMo on alumina catalysts, NiMo on alumina catalysts doped with boron and phosphorus and NiMO on silica-alumina catalysts are also preferred. Advantageously, eta or gamma alumina is selected.

When using noble metals (platinum and/or palladium), the metal content is preferably in the range 0.05% to 3% by weight with respect to the finished catalyst, preferably in the range 0.1% to 2% by weight of catalyst.

These metals are deposited on a support that is preferably an alumina, but can also be boron oxide, magnesia, zirconia, titanium oxide, a clay or a combination of these oxides. These catalysts can be prepared using any method known to the skilled person, or they can be acquired from companies specialising in preparing and marketing such catalysts.

In the hydrotreatment reactor (7), the feed is brought into contact with the catalyst in the presence of hydrogen at operating temperatures and pressures that can carry out hydrodeoxygenation (HDO) of the alcohols and hydrogenation of the olefins present in the feed. The reaction temperatures used in the hydrotreatment reactor are in the range 100° C. to 350° C., preferably in the range 150° C. to 300° C., still more preferably in the range 150° C. to 275° C., more preferably in the range 175° C. to 250° C. The total pressure range used is 5 to 150 bars, preferably in the range 10 to 100 bars, more preferably in the range 10 to 90 bars. The hydrogen supplied to hydrotreatment reactor is introduced at a flow rate such that the hydrogen/hydrocarbon volume ratio is in the range 100 to 3000 N./l/h, preferably in the range 100 to 2000 Nl/l/h, more preferably in the range 250 to 1500 Nl/l/h. The feed flow rate is such that the hourly space velocity is in the range 0.1 to 10 $h^{-1}$, preferably in the range 0.2 to 5 $h^{-1}$, more preferably in the range 0.2 to 3 $h^{-1}$. Under these conditions, the amount of unsaturated and oxygen-containing molecules is reduced from less than 0.5% to less than about 0.1% in general. The hydrotreatment step is carried out under conditions such that the conversion of products with boiling points of 370° C. or more into products with boiling points of less than 370° C. is limited to 30% by weight, preferably to less than 20% and more preferably less than 10%.

Step c)

The effluent from the hydrotreatment reactor is supplied via a line (8) to a fractionation zone (9) where it is fractionated into at least three fractions:

- at least one light fraction (leaving via line 10), the constituent compounds of which have boiling points lower than temperature T1 in the range 120° C. to 200° C., preferably in the range 130° C. to 180° C., more preferably at a temperature of about 150° C. In other words, the cut point is situated between 120° C. and 200° C.
- at least one intermediate fraction (line 11) comprising compounds with a boiling point in the range from the cut point T1 as defined above to a temperature T2 that is more than 300° C., more preferably more than 350° C. and less than 410° C., or still more preferably 370° C.
- at least one heavy fraction (line 12) comprising compounds with boiling points of more than the end point T2 defined above.

A cut between a boiling point T1 in the range 120-200° C. and T2, higher than 300° C. and less than 370° C., is preferred. The 370° C. cut is still more preferred, i.e., the heavy fraction is a 370° C.+cut.

Cutting at 370° C. can separate at least 90% by weight of the oxygen-containing compounds and the olefins, and usually at least 95% by weight. The heavy cut to be treated is then purified and eliminating the heteroatoms or unsaturated compounds by hydrotreatment is then unnecessary.

Fractionation is carried out by distillation in this instance, but it can be carried out in one or more steps and by means other than distillation.

This fractionation can be carried out by methods that are well known to the skilled person, such as flash and/or distillation, etc., The light fraction is not treated using the process of the invention but can, for example, constitute a good feed for a petrochemicals unit, more particularly for a steam cracker (steam cracking unit 5).

The intermediate and heavy fractions described above are treated using the process of the invention.

Step d)

At least a portion of said intermediate fraction is then introduced (line 11) into zone (14) containing hydroisomerisation/hydrocracking catalyst), along with an optional stream of hydrogen (line 13).

The hydroisomerisation/hydrocracking catalysts will be described below in more detail.

The operating conditions under which step d) is carried out are as follows:

The pressure is kept between 2 and 150 bars, preferably in the range 5 to 100 bars, advantageously 10 to 90 bars, the space velocity is in the range 0.1 $h^{-1}$ to 10 $h^{-1}$, preferably in t range 0.2 to 7 $h^{-1}$, and advantageously in the range 0.5 to 5.0 $h^{-1}$. The hydrogen flow rate is in the range 100 to 2000 normal litres of hydrogen per litre of feed per hour, preferably in the range 150 to 1500 litres of hydrogen per litre of feed.

The temperature used in this step is in the range 200° C. to 450° C., preferably in the range 250° C. to 450° C., advantageously in the range 300° C. to 450° C., more advantageously more than 320° C. or, for example, in the range 320-420° C.

Hydroisomerisation and hydrocracking step d) is advantageously carried out under conditions such that the conversion per pass of products with boiling points of 150° C. or more into products with boiling points of less than 150° C. is as low as possible, preferably less than 50%, more preferably less than 30%, and can produce middle distillates (gas oil and kerosine) with cold properties (pour point and freezing point) that are sufficiently good to satisfy existing specifications for that type of fuel.

This step d) seeks to encourage hydroisomerisation rather than hydrocracking.

Step e)

At least a portion of said heavy fraction is introduced via line (12) into a zone (15) where it is brought into contact with an amorphous hydroisomerisation/hydrocracking catalyst in the presence of hydrogen (25), to produce a middle distillate cut (kerosine+gas oil) with good cold properties.

The catalyst used in zone (15) of step e) to carry out the heavy fraction hydrocracking and hydroisomerisation reactions of the invention is the same type as that present in reactor (14). However, it should be noted that the catalysts used in reactors (14) and (15) can be identical or different.

In contact with the catalyst and in the presence of hydrogen during this step e), the fraction entering the reactor undergoes essentially hydrocracking reactions which, accompanied by n-paraffin hydroisomerisation reactions, improves the quality of the products formed, more particularly the cold properties of the kerosine and gas oil, and can also produce very good distillate yields. The conversion of products with boiling points of 370° C. or more into products with a boiling point of less than 370° C. is more than 80% by weight, often at least 85% and preferably 88% or more. In contrast, conversions of products with boiling points of less than 260° C. is at most 90% by weight, generally at most 70% or 80%, preferably at most 60% by weight.

In this step e), hydrocracking is thus encouraged, preferably by limiting gas oil cracking.

Choosing the operating conditions can finely adjust the quality of the products (diesel, kerosine) and in particular the cold properties of the kerosine, while retaining a good diesel and/or kerosine yield. The process of the invention can produce both kerosine and gas oil of good quality.

Step f)

The effluents from reactors (14) and (15) are sent via lines (16) and (17) to a distillation string, which combines atmospheric distillation and possibly vacuum distillation which separates the light products inevitably formed during steps d) and e), for example ($C_1$-$C_4$) gas (line 18) and a gasoline cut (line 19), and can distil at least one gas oil cut (line 21) and kerosine cut (line 20). The gas oil and kerosine fractions can be partially recycled (line 23) either together or separately, to the head of hydroisomerisation/hydrocracking reactor (14), step d).

A fraction (line 22) with a boiling point above that of gas oil, i.e., the constituent compounds of which have boiling points higher than those of middle distillates (kerosine+gas oil) is also distilled. This fraction, termed the residual fraction, generally has an initial boiling point of at least 350° C., preferably more than 370° C. This fraction is advantageously recycled to the head of the reactor (line 26) for hydroisomerisation/hydrocracking of the heavy fraction (step e).

It may also be advantageous to recycle a portion of the kerosine and/or the gas oil to step d), step e) or both steps. Preferably, a portion of at least one of the kerosine and/or gas oil fractions is recycled to step d) (zone 14). It has been shown that it is advantageous to recycle a portion of the kerosine to improve its cold properties.

Advantageously and at the same time, a portion of the non-hydrocracked fraction is recycled to step e) (zone 15).

Clearly, the gas oil and kerosine cuts are preferably recovered separately, but the cut points are adjusted by the operator to adapt to requirements.

FIG. 1 shows a distillation column (24), but two columns can be used to treat the cuts from zones (14) and (15) separately.

The figure shows only the kerosine recycle to the catalyst of reactor (14). Clearly, a portion of the gas oil can be recycled (separately or with the kerosine), preferably to the same catalyst as the kerosine.

Products Obtained

The gas oil(s) obtained have a pour point of at most 0° C., generally less than −10° C. and usually less than −15° C. The cetane index is more than 60, generally more than 65, usually more than 70.

The kerosine(s) obtained have a freezing point of at most −35° C., generally less than −40° C. The smoke point is more than 25 mm, generally more than 30 mm. In this process, as little (undesirable) gasoline as possible is produced. The gasoline yield will always be less 50% by weight, preferably less than 40% by weight, advantageously less than 30% by weight or 20% or even 15% by weight.

The invention also concerns a unit for producing middle distillates comprising:

- at least one zone (2) for fractionating a feed from a Fischer-Tropsch synthesis unit, containing at least one line (1) for introducing feed, at least one line (4) for withdrawing a heavy fraction with an initial boiling point equal to a temperature in the range 120-200° C., and at least one line (3) for withdrawing at least one fraction that is lighter than the heavy fraction;
- at least one hydrotreatment zone (7) provided with an inlet line for at least a portion of said heavy fraction;
- at least one zone (9) for fractionating the hydrotreated effluent having:
  - at least one line (8) for introducing an effluent;
  - at least 3 lines for withdrawing separate fractions, one (10) for withdrawing a light fraction boiling below an intermediate fraction, a further line (11) for withdrawing an intermediate fraction with an initial boiling point T1, T1 being in the range 120° C. to 200° C., and an end point T2 that is more than 300° C. and less than 410° C. and a further line (12) for withdrawing a heavy fraction with a boiling point that is higher than that of the intermediate fraction;
- at least one zone (14) containing a hydrocracking/hydroisomerisation catalyst provided with a line (11) for entry of at least a portion of said fraction;
- at least one zone (15) containing a hydrocracking/hydroisomerisation catalyst provided with a line (12) for entry of at least a portion of said heavy fraction;
- at least one distillation column (24) provided with a line (16, 17) for entry of effluents from zones (14) and (15), lines (20) and (21) for withdrawing middle distillates and a line (22) for withdrawing a residual fraction with a boiling point above that of the middle distillates;
- at least one line (26) for recycling the residual fraction to the zone (15) for treating the heavy fraction.

Preferably, it further comprises at least one line (3) for sending the light fraction to a steam cracking unit (5).

Advantageously, it comprises a line (23) for recycling a portion of at least the kerosine or gas oil fractions obtained from the outlet from the column (24) for distilling hydrocracked fractions, to at least one of zones (14, 15) containing a hydrocracking/hydroisomerisation catalyst.

Hydroisomerisation/Hydrocracking Catalysts

The majority of catalysts currently used for hydroisomerisation/hydrocracking are bifunctional in nature, combining an acid function with a hydrogenating function. The acid function is provided by supports with large surface areas (generally 150 to 800 $m^2/g$) with a superficial acidity, such as halogenated (chlorinated or fluorinated) aluminas, phosphorated aluminas, combinations of boron and aluminium oxides, silica-aluminas. The hydrogenating function is supplied either by one or more metals from group VIII of the periodic table, such as iron, cobalt, nickel, ruthenium, rhodium, palladium, osmium, iridium and platinum, or by combining at least one group VI metal such as chromium, molybdenum or tungsten and at least one group VIII metal.

The balance between the two, acid and hydrogenating, functions, is the fundamental parameter that governs the activity and selectivity of the catalyst. A weak acid function and a strong hydrogenating function produces catalysts that have low activity and selectivity as regards isomerisation, while a strong acid function and a weak hydrogenating function produces catalysts that are highly active as regards cracking. A third possibility is to use a strong acid function and a strong hydrogenating function to obtain a highly active catalyst that is also highly selective as regards isomerisation. Thus, it is possible to adjust the activity/selectivity balance of the catalyst by judicious choice of each of the functions.

More precisely, hydroisomerisation/hydrocracking catalysts are bifunctional catalysts comprising an amorphous acidic support (preferably a silica-alumina) and a hydrodehydrogenating metallic function provided by at least one noble metal.

The support is amorphous, i.e., free of molecular sieve, and in particular zeolite, as is the catalyst. The amorphous acidic support is advantageously a silica-alumina, but other supports can be used. When a silica-alumina is used, the catalyst preferably contains no added halogen apart from that which may be introduced during impregnation of the noble metal, for example. More generally and preferably, the catalyst contains no added halogen, for example fluorine. Generally, and preferably, the support has not undergone impregnation with a silicon compound.

A number of preferred catalysts will be described below for use in the hydrocracking/hydroisomerisation step of the process of the invention.

In a first preferred implementation of the invention, a catalyst is used that comprises a particular silica-alumina that can produce highly active catalysts that are also highly selective for isomerising effluents from Fischer-Tropsch synthesis units.

More precisely, the preferred catalyst comprises (and is preferably essentially constituted by) 0.05-10% by weight of at least one noble group VIII metal deposited on an amorphous silica-alumina support (which preferably contains 5% to 70% by weight of silica) with a BET specific surface area of 100-500 $m^2/g$ and the catalyst has:

- a mean mesopore diameter in the range 1-12 nm;
- a pore volume for pores with a diameter in the range from the mean diameter as defined above reduced by 3 nm to the mean diameter as defined above increased by 3 nm of more than 40% of the total pore volume;
- a noble metal dispersion in the range 20-100%;
- a noble metal distribution coefficient of more than 0.1.

In more detail, the characteristics of the catalyst are as follows:

The preferred support used to produce the catalyst is composed of silica $SiO_2$ and alumina, $Al_2O_3$. The amount of silica in the support, expressed as the percentage by weight, is generally in the range 1% to 95%, advantageously between 5% and 95%, preferably in the range 10% to 80%, more preferably in the range 20% to 70% and between 22% and 45%. This silica content can be precisely measured by X ray fluorescence.

For this particular type of reaction, the metallic function is supplied by a noble metal from group VIII of the periodic table, more particularly platinum and/or palladium.

The amount of noble metal, expressed as the % by weight of metal with respect to the catalyst, is in the range 0.05% to 10%, preferably in the range 0.1% to 5%.

The dispersion, representing the fraction of metal accessible to the reactant with respect to the total quantity of metal in the catalyst, can be measured by $H_2/O_2$ volumetric analysis, for example. The metal is firstly reduced, i.e., it undergoes a treatment in a stream of hydrogen at high temperature under conditions such that all of the platinum atoms accessible to hydrogen are transformed into the metal form. Then, a stream of oxygen is passed under operating conditions such that all of the reduced platinum atoms accessible to oxygen are oxidised to $PtO_2$. Calculating the difference between the quantity of oxygen introduced and the quantity of oxygen withdrawn leads to the quantity of oxygen consumed; then, the latter value can be used to deduce the quantity of platinum accessible to oxygen. The dispersion is then equal to the ratio of the quantity of platinum accessible to oxygen to the total quantity of platinum in the catalyst. In our case, the dispersion is in the range 20% to 100%, preferably in the range 30% to 100%.

The distribution of the noble metal represents the distribution of the metal in the catalyst grain; the metal can be well dispersed or poorly dispersed. It is possible for the platinum to be poorly distributed (for example, detected in a ring the thickness of which is substantially less than the grain radius) but well dispersed, i.e., all of the platinum atoms located in a ring are accessible to the reactants. In our case, the platinum distribution is good, i.e., the platinum profile, measured using the Castaing microprobe method, has a coefficient of distribution of more than 0.1, preferably more than 0.2.

The BET surface area of the support is in the range 100 $m^2/g$ to 500 $m^2/g$, preferably in the range 250 $m^2/g$ to 450 $m^2/g$, and for supports based on silica-alumina, it is more preferably in the range 310 $m^2/g$ to 450 $m^2/g$.

For preferred catalysts based on silica-alumina, the mean pore diameter of the catalyst is measured using a pore distribution profile obtained using a mercury porosimeter. The mean pore diameter is defined as the diameter corresponding to cancellation of the derivative curve obtained from the mercury porosity curve. The mean pore diameter, as defined, is in the range 1 nm ($1\times10^{-9}$ metres) to 12 nm ($12\times10^{-9}$ metres), preferably in the range 1 nm ($1\times10^{-9}$ to 11 nm ($11\times10^{-9}$ metres) and more preferably in the range 3 nm ($4\times10^{-9}$ metres) to 10.5 nm ($10.5\times10^{-9}$ metres).

The preferred catalyst has a pore distribution such that the pore volume of pores with a diameter in the range from the mean diameter as defined above reduced by 3 nm to the mean diameter as defined above increased by 3 nm (i.e., the mean diameter ±3 nm) is more than 40% of the total pore volume, preferably in the range 50% to 90% of the total pore volume, and more advantageously in the range 50% to 70% of the total pore volume.

For the preferred silica-alumina based catalyst, it is generally less than 1.0 ml/g, preferably in the range 0.3 to 0.9 ml/g, and more advantageously less than 0.85 ml/g.

The silica-alumina (in particular that used in the preferred implementation) is prepared and formed using the usual methods which are well known to the skilled person. Advantageously, prior to impregnating the metal, the support is calcined, for example by means of a heat treatment at 300-750° C. (preferably 600° C.) for a period in the range 0.25 to 10 hours (preferably 2 hours) in 0-30% by volume of water vapour (preferably about 7.5% for a silica-alumina matrix).

The noble metal salt is introduced using one of the usual methods for depositing a metal (preferably platinum and/or palladium, with platinum being preferred) on the surface of a support. One preferred method is dry impregnation, which consists of introducing the metal salt into a volume of solution which is equal to the pore volume of the catalyst mass to be impregnated. Before the reduction operation, the catalyst can be calcined, for example in dry air at 300-750° C. (preferably 520° C.) for 0.25-10 hours (preferably 2 hours).

In a second preferred implementation of the invention, the bifunctional catalyst comprises at least one noble metal deposited on an amorphous acidic support, the dispersion of the noble metal being less than 20%.

Preferably, the fraction of noble metal particles with a size of less than 2 nm represents at most 2% by weight of the noble metal deposited on the catalyst.

Advantageously, at least 70% (preferably at least 80% and more preferably at least 90%) of the noble metal particles have a size of more than 4 nm (number %).

The support is amorphous, and contains no molecular sieve; the catalyst also contains no molecular sieve.

The amorphous acidic support is generally selected from the group formed by a silica-alumina, a halogenated alumina (preferably fluorinated), a silicon-doped alumina (deposited silicon), a mixture of alumina and titanium oxide, a sulphated zirconia, a zirconia doped with tungsten, and mixtures thereof or with at least one amorphous matrix selected from the group formed by alumina, titanium oxide, silica, boron oxide, magnesia, zirconia or clay, for example. preferably, the support is constituted by an amorphous silica alumina.

A preferred catalyst comprises (preferably is essentially constituted by) 0.05% to 10% by weight of at least one noble group VIII metal deposited on an amorphous silica-alumina support.

In more detail, the characteristics of the catalyst are as follows:

The preferred support used to produce the catalyst is composed of silica $SiO_2$ and alumina, $Al_2O_3$ from its synthesis. The amount of silica in the support, expressed as the percentage by weight, is generally in the range 1% to 95%, advantageously between 5% and 95%, preferably in the range 10% to 80%, more preferably in the range 20% to 70% or even in the range 22% to 45%. This silica content can be precisely measured by X ray fluorescence.

For this particular type of reaction, the metallic function is supplied by a noble metal from group VIII of the periodic table, more particularly platinum and/or palladium.

The amount of noble metal, expressed as the % by weight of metal with respect to the catalyst, is in the range 0.05% to 10%, preferably in the range 0.1% to 5%.

The dispersion, (measured as above) is less than 20%, generally more than 1%, preferably 5%.

We used transmission electron microscopy to determine the size and distribution of the metal particles. After preparation, the catalyst sample was finely ground in an agate mortar then dispersed in ethanol using ultrasound. Samples were taken from different locations to ensure a true representation and were deposited on a copper grid coated with a thin carbon film. The grids were then air dried under an infrared lamp before being introduced into the microscope for observation. In order to estimate the average particle size of the noble metal, several hundred measurements were made from several tens of exposures. This set of measurements enabled a histogram of particle size distribution to be produced. We could then precisely estimate the proportion of particles corresponding to each particle size range.

The platinum distribution is good, i.e., the platinum profile, measured using the Castaing microprobe method, has a distribution coefficient of more than 0.1, advantageously more than 0.2, preferably more than 0.5.

The BET surface area of the support is generally in the range 100 $m^2/g$ to 500 $m^2/g$, preferably in the range 250 $m^2/g$ to 450 $m^2/g$, and for silica-alumina based supports, more preferably 310 $m^2/g$.

For silica-alumina based supports, it is generally less than 1.2 ml/g, preferably in the range 0.3 to 1.1 ml/g, and more advantageously less than 1.05 ml/g.

The silica-alumina and in general any support is prepared and formed using the usual methods which are well known to the skilled person. Advantageously, prior to impregnating the metal, the support is calcined, for example by means of a heat treatment at 300-750° C. (preferably 600° C.) for a period in the range 0.25 to 10 hours (preferably 2 hours) in 0-30% by volume of water vapour (preferably about 7.5% for a silica-alumina matrix).

The metal salt is introduced using one of the usual methods for depositing a metal (preferably platinum) on the surface of a support. One preferred method is dry impregnation which consists of introducing the metal salt into a volume of solution which is equal to the pore volume of the catalyst mass to be impregnated. Before the reduction operation and to obtain the metal particle size distribution, the catalyst is calcined in moist air at 300-750° C. (preferably 550° C.) for 0.25-10 hours (preferably 2 hours). The partial pressure of $H_2O$ during calcining is, for example, 0.05 bars to 0.50 bars (preferably 0.15 bars). Other known treatment methods for producing a dispersion of less than 20% are also suitable.

A further preferred catalyst for use in the invention comprises at least one hydrodehydrogenating element (preferably deposited on a support) and a support comprising (or preferably constituted by) at least one silica-alumina, said silica-alumina having the following characteristics:

- a silica $SiO_2$ weight content in the range 10% to 60%, preferably in the range 20% to 60%, more preferably in the range 20% to 50% by weight or 30% to 50% by weight;
- a Na content of less than 300 ppm by weight, preferably less than 200 ppm by weight;
- a total pore volume in the range 0.5 to 1.2 ml/g, measured by mercury porosimeter;
- with the porosity of said silica-alumina being as follows:
  - (i) the volume of mesopores with a diameter in the range 40 Å to 150 Å, wherein the mean diameter is in the range 80 Å to 120 Å, represents 30% to 80% of the total pore volume defined above, preferably in the range 40% to 70%.
  - (ii) The macropore volume, wherein the diameter is more than 500 Å, and preferably in the range 1000 Å to 10000 Å, represents between 20% and 80% of the total pore volume, preferably in the range 30% to 60% of the total pore volume; more preferably the macropore volume represents at least 35% of the total pore volume.
- a specific surface area of more than 200 $m^2/g$, preferably more than 250 $m^2/g$.

The following measurements are also carried out on the silica-alumina:

- diffractograms of the silica-aluminas of the invention, obtained by X ray diffraction, correspond to a mixture of silica and alumina with a certain evolution between the gamma alumina and the silica depending on the $SiO_2$ content in the samples. In these silica-aluminas, an alumina is observed that is of lower crystallinity compared with alumina alone.

The $^{27}Al$ NMR spectra of the silica-aluminas show two distinct blocks of peaks. Each block can be resolved into at least two species. We see a substantial domination of the species wherein the maximum resonates at about 10 ppm and which extends between 10 and 60 ppm. The position of the maximum suggests that these species are essentially type $Al_{VI}$ (octahedral). All of the spectra exhibit a second type of species that resonates at about 80-110 ppm. These species should correspond to $Al_{IV}$ (tetrahedral) atoms. For the silica contents of the present invention (between 10% and 60%), the proportions of tetrahedral $Al_{IV}$ species are close and are about 20% to 40%, preferably in the range 24% to 31%.

the silicon environment in the silica-aluminas studied by $^{29}Si$ NMR show the chemical displacements of the different silicon species, such as $Q^4$ (−105 ppm to −120 ppm), $Q^3$ (−90 ppm to −102 ppm) and $Q^2$ (−75 ppm to −93 ppm). Sites with a chemical displacement of −102 ppm can be sites of the $Q^3$ or $Q^4$ type, which are termed $Q^{3-4}$ sites in the present document. The silica-aluminas of the invention are composed of silicon of types $Q^2$, $Q^3$, $Q^{3-4}$ and $Q^4$. Many species should be type $Q^2$, approximately of the order of 30% to 50%. The proportion of $Q^3$ species is also high, approximately of the order of 10% to 30%. The sites are defined as follows:

$Q^4$ sites: Si bonded to 4 Si (or Al);

$Q^3$ sites: Si bonded to 3 Si (or Al) and 1 OH;

$Q^2$ sites: Si bonded to 2 Si (or Al) and 2 OH;

the homogeneity of the supports is evaluated by transmission electron microscopy. We seek here to check the homogeneity of the distribution of the Si and Al on a nanometer scale. Analyses are carried out on ultrafine sections of the supports, using different sized probes, 50 nm or 15 nm. 32 spectra were recorded for each solid studied, 16 with the 50 nm probe and 16 with the 15 nm probe. For each spectrum, the Si/Al atomic ratios are calculated, with the means of the ratios, the minimum ratio, the maximum ratio and the standard deviation for the series. The mean of the Si/Al ratios measured by scanning electron microscopy for the different silica-aluminas is close to the Si/Al ratio obtained by X ray fluorescence. The homogeneity criterion is evaluated on the basis of the standard deviation. Using these criteria, a large number of the silica-aluminas of the present invention can be considered to be heterogeneous as they have Si/Al atomic ratios with standard deviations of the order of 30-40%.

The support can be constituted by pure silica-alumina, or it can result from mixing said silica-alumina with a binder such as silica ($SiO_2$), alumina ($Al_2O_3$), clays, titanium oxide ($TiO_2$), boron oxide ($B_2O_3$) and zirconia ($ZrO_2$) or any mixture of these binders. Preferred binders are silica and alumina, more preferably alumina in all forms known to the skilled person, for example gamma alumina. The percentage by weight of the binder in the catalyst support is in the range 0 to 40%, more particularly in the range 1% to 40%, more preferably in the range 5% to 20%. This results in a silica-alumina content of 60-100% by weight. However, catalysts of the invention wherein the support is uniquely constituted by silica-alumina with no binder are preferred.

The support can be prepared by forming the silica-alumina in the presence or absence of a binder using any technique that is known to the skilled person. Forming can, for example, be carried out by extrusion, pelletisation, using the oil drop method, by plate granulation using a rotary plate or by any other method that is known to the skilled person. At least one calcining step can be carried out after any one of the preparation steps, normally carried out in air at a temperature of at least 150° C., preferably at least 300° C.

Finally, in a fourth preferred implementation of the invention, the catalyst is a bifunctional catalyst in which the noble metal is supported by a support essentially constituted by an amorphous silica-alumina gel and which is micro/mesoporous with a controlled pore size, with a surface area of at least 500 $m^2/g$ and a $SiO_2/Al_2O_3$ mole ratio in the range 30/1 to 500/1, preferably in the range 40/1 to 150/1.

The noble metal supported on the support can be selected from metals from groups 8, 9 and 10 of the periodic table, in particular Co, Ni, Pd or Pt. Palladium and platinum are preferably used. The proportion of noble metals is normally in the range 0.05% to 5.0% by weight with respect to the support weight. Particularly advantageous results have been obtained using palladium and platinum in proportions in the range 0.2% to 1.0% by weight.

Said support is generally obtained from a mixture of tetra-alkylated ammonium hydroxide, an aluminium compound that can be hydrolysed to $Al_2O_3$, a silica compound that can be hydrolysed to $SiO_2$ and a sufficient quantity of water to dissolve and hydrolyse these compounds, said tetra-alkylated ammonium compound containing 2 to 6 carbon atoms in each alkyl residue, said hydrolysable aluminium compound preferably being an aluminium trialkoxide containing 2 to 4 carbon atoms in each alkoxide residue and said hydrolysable silicon compound being a tetra-alkylorthosilicate containing 1 to 5 carbon atoms in each alkyl residue.

A variety of methods exist for producing the different supports with the characteristics mentioned above, for example as described in the descriptions in European patent applications EP-A-340 868, EP-A-659 478 and EP-A-812 804. In particular, an aqueous solution of the compounds mentioned above is hydrolysed and gelled by heating it, either in a confined atmosphere to bring it to boiling point or to a higher value, or in free air below that temperature. The gel obtained is then dried and calcined.

The tetra-alkyl ammonium hydroxide that can be used in the present invention is, for example, selected from tetraethyl ammonium hydroxide, propyl ammonium hydroxide, isopropyl ammonium hydroxide, butyl ammonium hydroxide, isobutyl ammonium hydroxide, ter-butyl ammonium hydroxide and pentyl ammonium hydroxide, preferably from tetrapropyl ammonium hydroxide, tetra-isopropyl ammonium hydroxide and tetrabutyl ammonium hydroxide. The aluminium trialkoxide is, for example, selected from aluminium triethoxide, propoxide, isopropoxide, butoxide, isobutoxide and terbutoxide, preferably from aluminium tripropoxide and tri-isopropxide. The tetra-alkylated orthosilicate is, for example, selected from tetramethyl-, tetraethyl-, propyl-, isopropyl-, butyl-, isobutyl-, ter-butyl- and pentyl-orthosilicate, preferably tetraethyl-orthosilicate.

In a typical procedure for preparing the support, an aqueous solution containing the tetra-alkylated ammonium hydroxide and aluminium trialkoxide is prepared at a temperature sufficient to guarantee effective dissolution of the aluminium compounds. The tetra-alkylated orthosilicate is added to said aqueous solution. This mixture is heated to a temperature suitable for activating the hydrolysis reactions. This temperature depends on the composition of the reaction mixture (generally 70° C. to 100° C.). The hydrolysis reaction is exothermic, guaranteeing a self-sustaining reaction after activation. Further, the proportions of the constituents of the mixture are such that they have the following mole ratios: $SiO_2/Al_2O_3$ of 30/1 to 500/1, tetra-alkylated ammonium hydroxide/$SiO_2$ of 0.05/1 to 0.2/1, and $H_2O/SiO_2$ of 5/1 to 40/1. Preferred values for these mole ratios are as follows: $SiO_2/Al_2O_3$ of 40/1 to 150/1, tetra-alkylated ammonium hydroxide/$SiO_2$ of 0.05/1 to 0.2/1, and $H_2O/SiO_2$ of 10/1 to 25/1.

Reactant hydrolysis and gelling are carried out at a temperature that is equal to or higher than the boiling point, at atmospheric pressure, of any alcohol developed in the form of a byproduct of said hydrolysis reaction, without elimination or significant elimination of these alcohols from the reaction medium. The hydrolysis and gelling temperature is thus critical and it is kept in an appropriate manner at values of more than about 65° C., of the order of about 110° C. Further, in order to maintain the development of the alcohol in the reaction medium, it is possible to operate using an autoclave with autogenous pressure of the system and a pre-selected temperature (normally of the order of 0.11-0.15 MPa abs), or at atmospheric pressure in a reactor provided with a reflux condenser.

In a particular implementation of the process, hydrolysis and gelling are carried out in the presence of a quantity of alcohol that is higher than that developed in the form of a by-product. To this end, a free alcohol, preferably ethanol, is added to the reaction mixture in a proportion that can be up to a maximum mole ratio of added alcohol/$SiO_2$ of 8/1.

The time required to carry out hydrolysis and gelling under the conditions indicated above is normally in the range 10 minutes to 3 hours, preferably in the range 1 to 2 hours.

It has also been discovered that it may be useful to age the gel obtained by keeping the reaction mixture in the presence of alcohol and under environmental temperature conditions for a period of the order of 1 to 24 hours.

Finally, the alcohol is extracted from the gel, which is then dried, preferably under reduced pressure (3 to 6 kPa, for example), at a temperature of 110° C. The dry gel then undergoes a calcining process in an oxidising atmosphere (normally in air), at a temperature in the range 500° C. to 700° C. for 4 to 20 hours, preferably at 500° C. to 600° C. for The silica and alumina gel obtained has a composition that corresponds to that of the reactants used, if it is assumed that the reaction yields are practically complete. The $SiO_2/Al_2O_3$ mole ratio is thus in the range 30/1 to 500/1, preferably in the range 40/1 to 150/1, preferred values being of the order of 100/1. This gel is amorphous, when analysed by powder X ray diffraction, it has a specific surface area of at least 500 $m^2/g$, generally in the range 600 to 850 $m^2/g$, and a pore volume of 0.4 to 0.8 $cm^3/g$.

A metal selected from noble metals from groups 8, 9 or 10 of the periodic table is supported on the amorphous micro/mesoporous silica-alumina gel obtained as described above. As indicated above, this metal is preferably selected from platinum and palladium, platinum being preferably used.

The proportion of noble metal, in particular platinum, in the supported catalyst is in the range 0.4% to 0.8%, preferably in the range 0.6% to 0.8% by weight with respect to the weight of the support.

Advantageously, the metal is uniformly distributed over the porous surface of the support to maximise the effectively active catalytic surface area. Different methods can be used to this end, such as those described in European patent application EP-A-582 347, the contents of which are hereby mentioned by reference. In particular, depending on the impregnation technique, the porous support with the characteristics of the acidic support a) described above is brought into contact with an aqueous or alcoholic solution of a compound of the desired metal for a period sufficient to produce a homogeneous distribution of the metal in the solid. This operation normally requires several minutes to several hours, preferably with stirring. $H_2PtF_6$, $H_2PtCl_6$, $[Pt(NH_3)_4]Cl_2$, $[Pt(NH_3)_4](OH)_2$ constitute examples of suitable soluble salts, along with the analogous palladium salts; mixtures of salts of different metals are also used in the context of the invention. Advantageously, the minimum quantity of aqueous liquid (normally water or an aqueous mixture with a second inert liquid or with an acid in a proportion of less than 50% by weight) is used that is required to dissolve the salt and uniformly impregnate said support, preferably with a solution/support ratio in the range 1 to 3. The quantity of metal used is selected as a function of the desired concentration in the catalyst, all of the metal being fixed to the support.

Following impregnation, the solution is evaporated off and the solid obtained is dried and calcined in an inert or reducing atmosphere under temperature and time conditions analogous to those described above for calcining the support.

A further impregnation method is by ion exchange. To this end, the support constituted by the amorphous silica-alumina gel is brought into contact with an aqueous solution of a metal salt used, as in the preceding case, but it is deposited by ion exchange under conditions that are rendered basic (pH in the range 8.5 to 11) by adding a sufficient quantity of an alkaline compound, generally ammonium hydroxide. The solid in suspension is then separated from the liquid by filtering and decanting, then dried and calcined as described above.

In a still further method, a transition metal salt can be included in the silica-alumina gel during the preparation phase, for example before hydrolysis to form the moist gel, or before calcining. Although this latter method is advantageously easier to carry out, the catalyst obtained is slightly less active and selective than that obtained with the two preceding methods.

The supported catalyst described above can be used as it is or during the hydrocracking step of the process of the present invention after activation using one of the methods that are known and/or are described below. However, in a preferred implementation, said supported catalyst is reinforced by adding to the mixture a suitable quantity of an inert mineral solid that can improve its mechanical characteristics. The catalyst is preferably used in the granular form rather than in the powder form with a relatively narrow particle distribution. Further, the catalyst advantageously has a compressive strength and shock resistance that is sufficient to prevent crushing during the hydrocracking step.

Extrusion and forming methods are also known that use a suitable inert additive (or binder) capable of supplying the properties mentioned above, for example using the methods described in European patent applications EP-A-550 922 and EP-A-665 055, this latter being preferably used, the contents of which are hereby mentioned by way of reference.

A typical method for preparing the catalyst in an extruded form (EP-A-665 055) comprises the following steps:

a) heating the solution of hydrosoluble components obtained as described above to cause hydrolysis and gelling of said solution to obtain a mixture A with a viscosity in the range 0.01 to 100 Pa.sec;

b) a binder from the boehmite or pseudoboehmite group is firstly added to mixture A, in a weight ratio with mixture A in the range 0.05 to 0.5, then a mineral or organic acid is added in a proportion in the range 0.5 to 8.0 g per 100 g of binder;

c) the mixture obtained at b) is heated, with stirring, to a temperature in the range 40° C. to 90° C. to obtain a homogeneous paste that is then extruded and granulated;

d) the extruded product is dried and calcined in an oxidising atmosphere.

Plasticizers such as methylcellulose are also preferably added during step b) to encourage formation of a homogeneous mixture that is easy to process.

A granular acid support comprising 30% to 70% by weight of inert mineral binder is then obtained, the remaining proportion being constituted by amorphous silica-alumina with essentially the same porosity, specific surface area and structure characteristics as those described above for the same gel without binder. The granules are advantageously in the form of pellets about 2-5 mm in diameter and 2-10 mm long.

The noble metal is then deposited on the granular acidic support using the procedure described above.

After preparation (for example as described in the above implementations) and before use in the conversion reaction, the metal contained in the catalyst has to be reduced. One preferred method for reducing the metal is treatment in hydrogen at a temperature in the range 150° C. to 650° C. and at a total pressure in the range 0.1 to 25 MPa. As an example, reduction consists of a stage at 150° C. for 2 hours then raising the temperature to 450° C. at a rate of 1° C./min followed by a 2 hour stage at 450° C.; throughout this reduction step, the hydrogen flow rate is 1000 litres of hydrogen/litre of catalyst. It should be noted that any in situ or ex situ reduction method is suitable.

Preferably, and in particular for the catalyst of the last preferred implementation, a typical method carrying out the procedure described above is as follows:

1) 2 hours at ambient temperature in a stream of nitrogen;
2) 2 hours at 50° C. in a stream of hydrogen;
3) heating to 310-360° C. with a temperature rise rate of 3° C./min in a stream of hydrogen;
4) constant temperature stage at 310-360° C. for 3 hours in a stream of hydrogen and cooling to 200° C.

During activation, the pressure in the reactor is kept between 30 and 80 atmospheres.

The entire disclosures of all applications, patents and publications, cited herein and of corresponding French Application No.01/08.971, filed Jul. 6, 2001 is incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for producing middle distillates from a paraffin feed produced by the Fischer-Tropsch process, comprising the following successive steps:

a) separating a single fraction, termed the heavy fraction, with an initial boiling point in the range 120-200° C.;

b) hydrotreating at least a portion of said heavy fraction;

c) fractionating into at least three fractions:

at least one intermediate fraction with an initial boiling point T1 in the range 120° C. to 200° C., and an end point T2 of more than 300° C. and less than 410° C.;

at least one light fraction with a boiling point below that of the intermediate fraction;

at least one heavy fraction with a boiling point above that of the intermediate fraction;

d) passing at least a portion of said intermediate fraction over an amorphous hydroisomerisation/hydrocracking catalyst;

e) passing at least a portion of said heavy fraction over an amorphous hydrocracking/hydroisomerisation catalyst;

f) distilling the hydrocracked/hydroisomerised fractions to obtain middle distillates, and recycling the residual fraction with a boiling point above that of said middle distillates to step e) over the amorphous catalyst treating the heavy fraction, in which process reaction conditions in (d) favor hydroisomerization over hydrocracking, and reaction conditions in (e) favor hydrocracking over hydroisomerization, and wherein the catalysis in d) and e) are catalysts comprising at least one noble metal and a silica-alumina support.

2. A process according to claim 1, in which a light fraction remaining in step a) after separation of said heavy fraction is sent to a steam cracking step.

3. A process according to claim 1, in which temperature T2 is less than 370° C. and more than 300° C.

4. A process according to claim 1, in which the light fraction separated in step c) is sent to a steam cracking step.

5. A process according to claim 1, in which contact with the hydroisomerisation/hydrocracking catalysts of steps d) and e) is made at a pressure of 2 to 150 bars, at a space velocity of 0.1 to 10 $h^{-1}$, with a hydrogen flow rate in the range 100 to 200 Nl/l of feed per hour, at a temperature of 200° C. to 450° C.

6. A process according to claim 1, in which for step d), the conversion of products with boiling points of 150° C. or more to products with a boiling point of less than 150° C. is less than 50% by weight.

7. A process according to claim 1, in which for step e), the conversion of products with boiling points of 260° C. or more to products with a boiling point of less than 260° C. is at most 90% by weight.

8. A process according to claim 1, in which during the distillation step, a residual fraction boiling above gas oil is recycled to step e) to pass over the hydrocracking/hydroisomerisation catalyst.

9. A process according to claim 1, in which during the distillation step, a portion of at least one of the kerosine or gas oil fractions is recycled to at least one of steps d) or e) to pass over the hydrocracking/hydroisomerisation catalyst(s).

10. A process according to claim 1, in which the amorphous catalysts of steps d) and e) contain no added halogen.

11. A process according to claim 1, in which the amorphous catalysts of steps d) and e) are not fluorinated.

12. A process according to claim 1, in which hydrotreatment is carried out using a supported catalyst comprising at least one group VIII metal and/or group VI metal and at least one element deposited on the support and selected from the group consisting of phosphorus, boron and silicon.

13. A process according to claim 12 wherein said supported catalyst comprises both at least one group VIII metal and a group VI metal.

14. A process for producing middle distillates from a paraffin feed produced by the Fischer-Tropsch process, comprising the following successive steps:

a) separating a single fraction, termed the heavy fraction, with an initial boiling point in the range 120-200° C.;

b) hydrotreating at least a portion of said heavy fraction;

c) fractionating into at least three fractions:

at least one intermediate fraction with an initial boiling point T1 in the range 120° C. to 200° C., and an end point T2 of more than 300° C. and less than 410° C.;

at least one light fraction with a boiling point below that of the intermediate fraction;

at least one heavy fraction with a boiling point above that of the intermediate fraction;

d) passing at least a portion of said intermediate fraction over an amorphous hydroisomerisation/hydrocracking catalyst comprising at least one noble metal and a silica-alumina support and wherein the conversion per pass of products with boiling points of 150° C. is less than 50%;

e) passing at least a portion of said heavy fraction over an amorphous hydrocracking/hydroisomerisation catalyst comprising at least one noble metal and a silica-alumina support and wherein the conversion of products with boiling points of 370° C. is more than 80% and;

f) distilling the hydrocracked/hydroisomerised fractions to obtain middle distillates, and recycling the residual fraction with a boiling point above that of said middle distillates to step e) over the amorphous catalyst treating the heavy fraction, in which process reaction conditions in (d) favor hydroisomerization over hydrocracking, and reaction conditions in (e) favor hydrocracking over hydroisomerization and in which a portion of at least one of the kerosine or gas oil fractions is recycled to at least one of steps d) or e) to pass over the hydrocracking/hydroisomerisation catalysts(s).

* * * * *

UNITED STATES PATENT AND TRADEMARK OFFICE

CERTIFICATE OF CORRECTION

PATENT NO. : 7,326,331 B2
APPLICATION NO. : 10/189736
DATED : February 5, 2008
INVENTOR(S) : Eric Benazzi It is certified that error appears in the above-identified patent and that said Letters Patent is hereby corrected as shown below:

Column 18, line 23, reads “catalysis” should read --catalysts--
Column 18, line 36, reads “100 to 200” should read --100 to 2000--
Column 20, line 10, delete line break after “distillates to step”
Column 20, line 18, reads “catalysts(s).” should read --catalyst(s).--

Signed and Sealed this

Third Day of February, 2009

JOHN DOLL
*Acting Director of the United States Patent and Trademark Office*